US006282742B1

(12) United States Patent
Boggs

(10) Patent No.: US 6,282,742 B1
(45) Date of Patent: Sep. 4, 2001

(54) CIRCULAR WINDSHIELD ICE SCRAPER

(76) Inventor: Patrick Boggs, 10101 De Soto Ave., #12, Chatsworth, CA (US) 91311-3289

( * ) Notice: Subject to any disclaimer, the term of this patent is extended or adjusted under 35 U.S.C. 154(b) by 0 days.

(21) Appl. No.: 09/697,970

(22) Filed: Oct. 26, 2000

(51) Int. Cl.[7] ..... B60S 1/04; A47L 1/06; A47L 13/02

(52) U.S. Cl. ..... 15/236.02; 15/143.1; 15/236.07

(58) Field of Search ..... 15/236.01, 236.02, 15/236.07, 143.1

(56) References Cited

U.S. PATENT DOCUMENTS

| | | | |
|---|---|---|---|
| D. 156,638 | | 12/1949 | Lifshutz et al. . |
| 2,299,089 | * | 10/1942 | Haan . |
| 3,214,834 | | 11/1965 | Bell . |
| 4,275,476 | | 6/1981 | Hopkins et al. . |
| 4,422,206 | | 12/1983 | Brace et al. . |
| 4,719,660 | | 1/1988 | Hopkins . |
| 5,013,092 | * | 5/1991 | Kulhawy . |
| 5,101,529 | * | 4/1992 | Tippie . |
| 5,179,754 | * | 1/1993 | Stradnick . |
| 5,263,222 | | 11/1993 | Johnstone, II . |
| 5,758,983 | * | 6/1998 | Thomas . |
| 5,781,957 | * | 7/1998 | Scholl . |

FOREIGN PATENT DOCUMENTS

| | | | |
|---|---|---|---|
| 3341529 | * | 5/1985 | (DE) . |

* cited by examiner

*Primary Examiner*—Randall E. Chin

(57) ABSTRACT

A circular windshield ice scraper for scraping ice and frost off of the windshield and windows of a vehicle. The circular windshield ice scraper includes a scraping blade has a top face, a generally frusta-conical perimeter side, and a downwardly facing concave bottom face. The perimeter side and the bottom face of the scraping blade form a generally circular lower scraping edge designed for scraping ice off of a surface. The ice scraper also includes a body coupled to the scraping blade. The body has a generally frusta-conical lower portion and an upper portion. The upper portion is designed for grasping by a user's hand.

11 Claims, 2 Drawing Sheets

CIRCULAR WINDSHIELD ICE SCRAPER

BACKGROUND OF THE INVENTION

1. Field of the Invention

The present invention relates to ice scrapers and more particularly pertains to a new circular windshield ice scraper for scraping ice and frost off of the windshield and windows of a vehicle.

2. Description of the Prior Art

The use of ice scrapers is known in the prior art. More specifically, ice scrapers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,422,206; U.S. Pat. No. 3,214,834; U.S. Pat. No. 5,263,222; U.S. Pat. No. 4,275,476; U.S. Pat. No. 4,719,660; and U.S. Pat. No. Des. 156,638.

While these devices fulfill their respective, particular objectives and requirements, the aforementioned patents do not disclose a new circular windshield ice scraper. The inventive device includes a scraping blade has a top face, a generally frusta-conical perimeter side, and a downwardly facing concave bottom face. The perimeter side and the bottom face of the scraping blade form a generally circular lower scraping edge designed for scraping ice off of a surface. The ice scraper also includes a body coupled to the scraping blade. The body has a generally frusta-conical lower portion and an upper portion. The upper portion is designed for grasping by a user's hand.

In these respects, the circular windshield ice scraper according to the present invention substantially departs from the conventional concepts and designs of the prior art, and in so doing provides an apparatus primarily developed for the purpose of scraping ice and frost off of the windshield and windows of a vehicle.

SUMMARY OF THE INVENTION

In view of the foregoing disadvantages inherent in the known types of ice scrapers now present in the prior art, the present invention provides a new circular windshield ice scraper construction wherein the same can be utilized for scraping ice and frost off of the windshield and windows of a vehicle.

The general purpose of the present invention, which will be described subsequently in greater detail, is to provide a new circular windshield ice scraper apparatus and method which has many of the advantages of the ice scrapers mentioned heretofore and many novel features that result in a new circular windshield ice scraper which is not anticipated, rendered obvious, suggested, or even implied by any of the prior art ice scrapers, either alone or in any combination thereof.

To attain this, the present invention generally comprises a scraping blade has a top face, a generally frusta-conical perimeter side, and a downwardly facing concave bottom face. The perimeter side and the bottom face of the scraping blade form a generally circular lower scraping edge designed for scraping ice off of a surface. The ice scraper also includes a body coupled to the scraping blade. The body has a generally frusta-conical lower portion and an upper portion. The upper portion is designed for grasping by a user's hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new circular windshield ice scraper apparatus and method which has many of the advantages of the ice scrapers mentioned heretofore and many novel features that result in a new circular windshield ice scraper which is not anticipated, rendered obvious, suggested, or even implied by any of the prior art ice scrapers, either alone or in any combination thereof.

It is another object of the present invention to provide a new circular windshield ice scraper which may be easily and efficiently manufactured and marketed.

It is a further object of the present invention to provide a new circular windshield ice scraper which is of a durable and reliable construction.

An even further object of the present invention is to provide a new circular windshield ice scraper which is susceptible of a low cost of manufacture with regard to both materials and labor, and which accordingly is then susceptible of low prices of sale to the consuming public, thereby making such circular windshield ice scraper economically available to the buying public.

Still yet another object of the present invention is to provide a new circular windshield ice scraper which provides in the apparatuses and methods of the prior art some of the advantages thereof, while simultaneously overcoming some of the disadvantages normally associated therewith.

Still another object of the present invention is to provide a new circular windshield ice scraper for scraping ice and frost off of the windshield and windows of a vehicle.

Yet another object of the present invention is to provide a new circular windshield ice scraper which includes a scraping blade has a top face, a generally frusta-conical perimeter side, and a downwardly facing concave bottom face. The perimeter side and the bottom face of the scraping blade form a generally circular lower scraping edge designed for scraping ice off of a surface. The ice scraper also includes a body coupled to the scraping blade. The body has a generally frusta-conical lower portion and an upper portion. The upper portion is designed for grasping by a user's hand.

Still yet another object of the present invention is to provide a new circular windshield ice scraper that allows a user to use a circular motion to remove ice from a windshield or window.

Even still another object of the present invention is to provide a new circular windshield ice scraper that lets a user apply more force to remove ice than is possible with conventional ice scrapers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
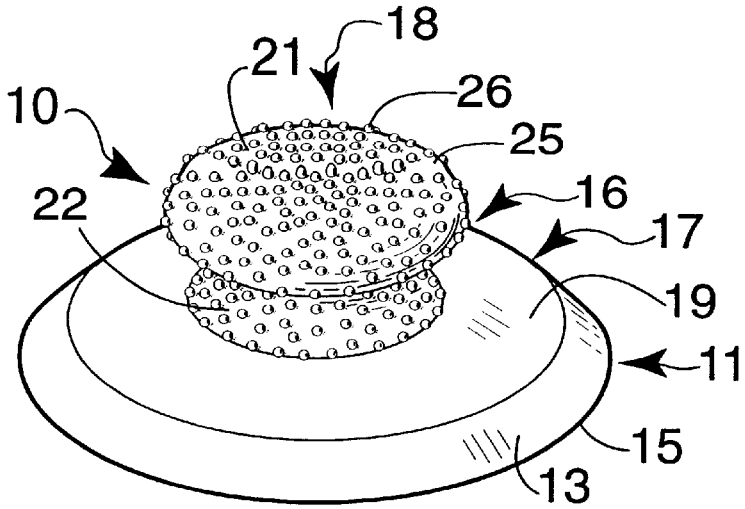
FIG. 1 is a schematic perspective view of a new circular windshield ice scraper according to the present invention.
Figure 2:
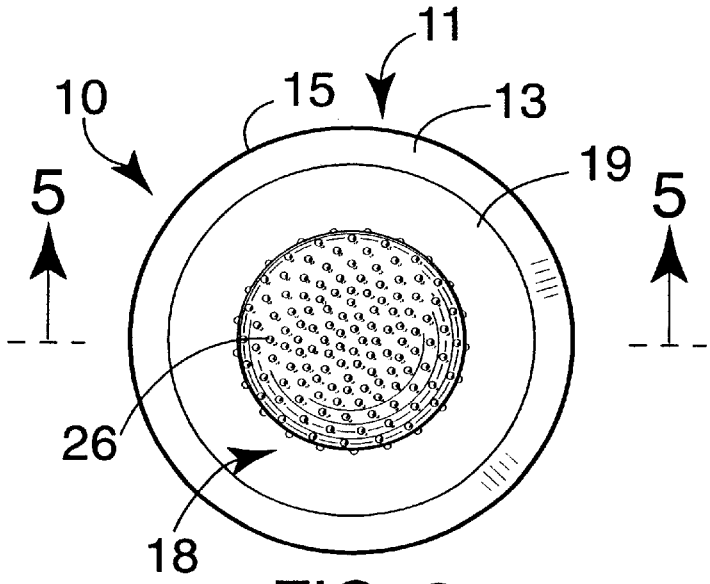
FIG. 2 is a schematic top view of the present invention.
Figure 3:
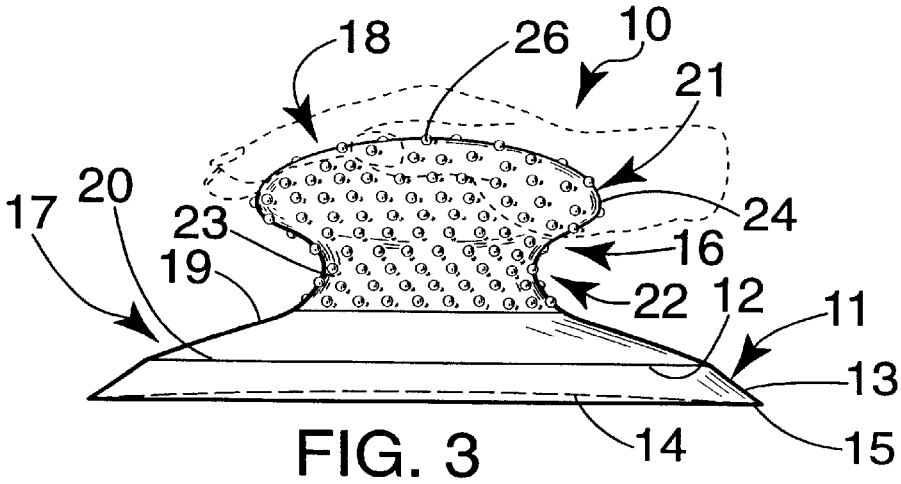
FIG. 3 is a schematic side view of the present invention.
Figure 4:
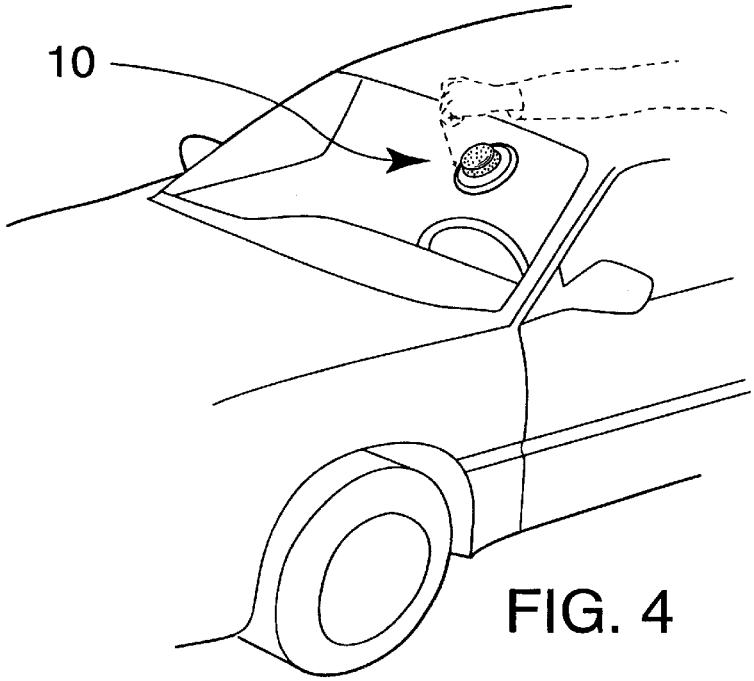
FIG. 4 is a schematic perspective view of the present invention in use on a windshield.
Figure 5:
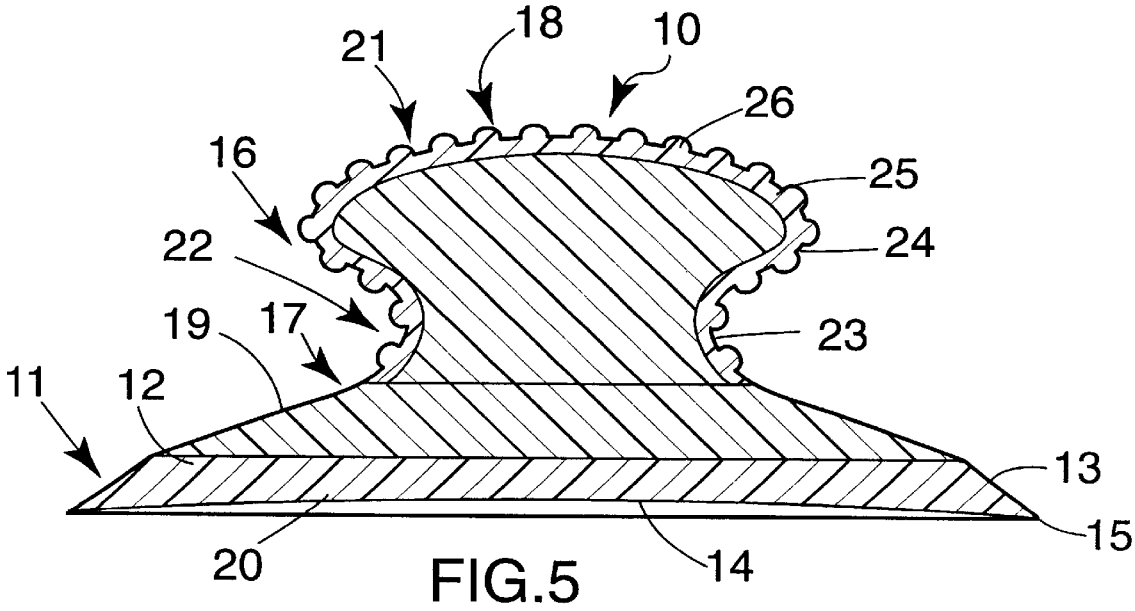
FIG. 5 is a schematic cross sectional view of the present invention taken from line 5—5 of FIG. 2.

With reference now to the drawings, and in particular to FIGS. 1 through 5 thereof, a new circular windshield ice scraper embodying the principles and concepts of the present invention and generally designated by the reference numeral 10 will be described.

As best illustrated in FIGS. 1 through 5, the circular windshield ice scraper 10 generally comprises a scraping blade has a top face, a generally frusta-conical perimeter side, and a downwardly facing concave bottom face. The perimeter side and the bottom face of the scraping blade form a generally circular lower scraping edge designed for scraping ice off of a surface. The ice scraper also includes a body coupled to the scraping blade. The body has a generally frusta-conical lower portion and an upper portion. The upper portion is designed for grasping by a user's hand.

In closer detail, the ice scraper 10 includes a scraping blade 11 having a top face 12, a generally frusta-conical perimeter side 13, and a downwardly facing concave bottom face 14. The perimeter side and the bottom face of the scraping blade form a generally circular lower scraping edge 15 designed for scraping ice and frost off of a surface such as a windshield or window. The concave shape of the bottom face of the scraping blade helps direct force applied on the ice scraper during use towards the lower scraping edge.

In an illustrative embodiment, the lower scraping edge may have an outer diameter of about 3 inches which provides a scraping edge has an optimal radius of curvature for easily removing ice from a windshield or window without increasing the risk of scraping the glass of the windshield or window (which is increased as the diameter gets smaller).

The scraping blade may comprise a metal material such as brass or a plastic material such as the plastic sold under the trade name LEXAN.

A body 16 is coupled to the scraping blade. The body has a generally frusta-conical lower portion 17 and an upper portion 18. The lower portion of the body has a generally frusta-conical perimeter side 19 and a generally circular substantially planar lower face 20. The lower face of the lower portion is coupled to the top face of the scraping blade to coupled the body to the scraping blade.

In one embodiment, the scraping blade and the upper and lower portions of the body are coaxial with one another. In such an embodiment, the lower face of the lower portion and the top face of the scraping blade may have substantially equal circular outer perimeters.

The perimeter side of the scraping blade is extended at a first acute angle to a plane in which the lower scraping edge of the scraping blade lies. The perimeter side of the lower portion of the body is extended at a second acute angle to a plane in which the lower surface of the lower portion of the body lies. In one embodiment, the first acute angle may be greater than the second acute angle such that the slope of the perimeter side of the scraping blade is steeper than the slope of the perimeter side of the lower portion. These angles allow easier directing of ice scraping scraped off ice and frost away from the lower scraping edge by making the slope more gentler the further away the ice scrapings are pushed up the perimeter sides of the ice scrape. As the ice scrapings get to the perimeter side of the lower portion, the slope is lessened to compensate for the increased amount of accumulated mass that must be pushed away from the lower scraping edge. This helps reduce accumulation directly around the lower scraping edge, in contrast, the steeper the slope of the perimeter side of the lower portion is (i.e. where the second acute angle is greater than the first acute angle), the more force has to be used to push the ice scrapings further up the perimeter sides away from the lower scraping edge.

In one illustrative embodiment, the first acute angle is about 40 degrees and the second acute angle is about 30 degrees which is believed to be optimal for optimal movement of ice scrapings up the perimeter sides and away from the lower scraping edge as the ice scraper is used to remove ice and frost from a surface.

The upper portion of the body has a knob region 21 and a constricted region 22 interposed between the knob region and the lower portion of the body. The constricted region of the upper portion has an outer diameter less than an outer diameter of the knob region. The constricted region may also have an inner most diameter less than an outer diameter of a top end of the perimeter of the lower portion.

The constricted region has a concave annular side 23 therearound. The knob region has a convex rounded side 24 therearound and a convex rounded upper face continuous with the rounded side of the knob region. In one embodiment, the annular side of the constricted region and the rounded side of the knob region may have substantially equal radii of curvature.

In use, the upper portion of the body is designed for grasping by a user's hand with the knob portion designed for fitting against the palm of the user's hand to apply force on the ice scraper when scraping ice from a windshield or window. The upper portion of the body may also have a resiliently deformable outer coating 25 covering the knob and constricted regions. The outer coating may comprise a resiliently deformable rubber or plastic material. In use, the outer coating is designed for enhancing the grip of the user on the upper portion of the body. The outer coating may also have a plurality of outwardly extending resiliently deformable nubs 26 for furthering enhancing the grip of the user on the upper portion of the body by increasing frictional contact with the user's hand.

In use, a user grasps the upper portion of the body and places the scraping blade on the surface to be scraped with the bottom face facing towards the surface. The user then moves the ice scraper in a circular motion while applying pressure to the ice scraper in a direction towards the surface to scrape ice and frost off of the surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ice scraper, comprising:

a scraping blade having a top face, a generally frusta-conical perimeter side, and a downwardly facing concave bottom face;

said perimeter side and said bottom face of said scraping blade forming a generally circular lower scraping edge adapted for scraping ice off of a surface;

a body coupled to said scraping blade;

said body having a generally frusta-conical lower portion and an upper portion, said upper portion being adapted for grasping by a user's hand;

wherein said upper portion of said body has a resiliently deformable outer coating.

2. The ice scraper of claim 1, wherein said perimeter side of said scraping blade being extended at a first acute angle to a plane in which said lower scraping edge of said scraping blade lies, wherein a perimeter side of said lower portion of said body is extended at a second acute angle to a plane in which a lower face of said lower portion of said body lies, and wherein said first acute angle is greater than said second acute angle.

3. The ice scraper of claim 1, wherein said upper portion of said body has a knob region and a constricted region interposed between said knob region and said lower portion of said body, wherein said constricted region of said upper portion having an outer diameter less than an outer diameter of said knob region.

4. The ice scraper of claim 3, wherein said constricted region has an inner most diameter less than an outer diameter of a top end of said perimeter of said lower portion.

5. The ice scraper of claim 4, wherein said constricted region has a concave annular side therearound, wherein said knob region having a convex rounded side therearound and a convex rounded upper face continuous with said rounded side of said knob region, and wherein said annular side of said constricted region and said rounded side of said knob region have substantially equal radii of curvature.

6. An ice scraper, comprising:

a scraping blade having a top face, a generally frusta-conical perimeter side, and a downwardly facing concave bottom face;

said perimeter side and said bottom face of said scraping blade forming a generally circular lower scraping edge adapted for scraping ice off of a surface;

said perimeter side of said scraping blade being extended at a first acute angle to a plane in which said lower scraping edge of said scraping blade lies;

a body coupled to said scraping blade;

said body having a generally frusta-conical lower portion and an upper portion;

said lower portion of said body having a generally frusta-conical perimeter side and a generally circular substantially planar lower face; said lower face of said lower portion being coupled to said top face of said scraping blade to coupled said body to said scraping blade;

said perimeter side of said lower portion of said body being extended at a second acute angle to a plane in which said lower face of said lower portion of said body lies;

said first acute angle being greater than said second acute angle;

said upper portion of said body having a knob region and a constricted region interposed between said knob region and said lower portion of said body;

said constricted region of said upper portion having an outer diameter less than an outer diameter of said knob region;

said constricted region having an inner most diameter less than an outer diameter of a top end of said perimeter of said lower portion;

said constricted region having a concave annular side therearound;

said knob region having a convex rounded side therearound and a convex rounded upper face continuous with said rounded side of said knob region;

said annular side of said constricted region and said rounded side of said knob region having substantially equal radii of curvature; and said upper portion of said body having a resiliently deformable outer coating covering said knob and constricted regions.

7. An ice scraper, comprising:

a scraping blade having a top, a bottom, and a generally frusta-conical perimeter side extending between said top and bottom, said scraping blade having a downwardly facing concave bottom face, said perimeter side and said bottom face of said scraping blade forming a generally circular lower scraping edge adapted for scraping ice off of a surface; and a body coupled to said scraping blade, said body having a lower portion and an upper portion, said upper portion being generally bulbous for grasping by a user's hand;

wherein said upper portion of said body has a resiliently deformable outer coating.

8. The ice scraper of claim 7, wherein said perimeter side of said scraping blade is extended at a first acute angle to a plane in which said lower scraping edge of said scraping blade lies, wherein a perimeter side of said lower portion of said body is extended at a second acute angle to a plane in which a lower face of said lower portion of said body lies, and wherein said first acute angle is greater than said second acute angle.

9. The ice scraper of claim 7, wherein said upper portion of said body has a knob region and a constricted region interposed between said knob region and said lower portion of said body, wherein said constricted region of said upper portion has an outer diameter less than an outer diameter of said knob region.

10. The ice scraper of claim 9, wherein said constricted region has an innermost diameter less than an outer diameter of a top end of said perimeter of said lower portion.

11. The ice scraper of claim 10, wherein said constricted region has a concave annular side therearound, wherein said knob region has a convex rounded side therearound and a convex rounded upper face continuous with said rounded side of said knob region, and wherein said annular side of said constricted region and said rounded side of said knob region have substantially equal radii of curvature.

* * * * *